US010248055B2

(12) United States Patent
Ikebuchi et al.

(10) Patent No.: US 10,248,055 B2
(45) Date of Patent: Apr. 2, 2019

(54) FIXING DEVICE INCLUDING A LUBRICANT HOLDER AND IMAGE FORMING APPARATUS

(71) Applicants: Yutaka Ikebuchi, Kanagawa (JP); Takuya Seshita, Kanagawa (JP); Yasuharu Kawarasaki, Tochigi (JP); Kohichi Utsunomiya, Kanagawa (JP)

(72) Inventors: Yutaka Ikebuchi, Kanagawa (JP); Takuya Seshita, Kanagawa (JP); Yasuharu Kawarasaki, Tochigi (JP); Kohichi Utsunomiya, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/006,677

(22) Filed: Jun. 12, 2018

(65) Prior Publication Data

US 2018/0373187 A1 Dec. 27, 2018

(30) Foreign Application Priority Data

Jun. 26, 2017 (JP) ..... 2017-124188

(51) Int. Cl.
*G03G 15/20* (2006.01)

(52) U.S. Cl.
CPC . *G03G 15/2025* (2013.01); *G03G 2215/2093* (2013.01)

(58) Field of Classification Search
CPC ..... G03G 15/2025
USPC ..... 399/320, 329
See application file for complete search history.

(56) References Cited

U.S. PATENT DOCUMENTS

| | | | | |
|---|---|---|---|---|
| 8,290,416 | B2 * | 10/2012 | Kim | G03G 15/2025 399/320 |
| 8,831,495 | B2 * | 9/2014 | Kim et al. | G03G 15/2025 399/329 |
| 10,114,321 | B2 * | 10/2018 | Mitsui | G03G 15/2025 |
| 2011/0044734 | A1 | 2/2011 | Shimokawa et al. | |
| 2012/0177388 | A1 | 7/2012 | Imada et al. | |
| 2013/0045032 | A1 | 2/2013 | Shimokawa et al. | |
| 2013/0164056 | A1 | 6/2013 | Imada et al. | |

(Continued)

FOREIGN PATENT DOCUMENTS

| | | |
|---|---|---|
| JP | 2001-203062 | 7/2001 |
| JP | 2002-093565 | 3/2002 |
| JP | 2002-357968 | 12/2002 |

(Continued)

*Primary Examiner* — William J Royer
(74) *Attorney, Agent, or Firm* — Duft & Bornsen, PC

(57) ABSTRACT

A fixing device is provided that includes a fixing belt rotatable in a predetermined direction, a heater to heat the fixing belt, a pressure rotator in contact with an outer circumferential surface of the fixing belt, a nip formation pad disposed inside a loop formed by the fixing belt and pressed against the pressure rotator via the fixing belt to form a fixing nip, and a pair of guides in contact with an inner circumferential surface of the fixing belt at both ends of the fixing belt in a width direction thereof, to maintain a substantially cylindrical posture of the fixing belt. Each of the guides includes a guide portion in contact with the inner circumferential surface of the fixing belt and a lubricant holder holding a lubricant that is disposed adjacent to the guide portion and not in contact with the inner circumferential surface of the fixing belt.

7 Claims, 5 Drawing Sheets

(56) References Cited

U.S. PATENT DOCUMENTS

| | | | |
|---|---|---|---|
| 2013/0170879 | A1 | 7/2013 | Yoshinaga et al. |
| 2016/0011549 | A1 | 1/2016 | Utsunomiya et al. |

FOREIGN PATENT DOCUMENTS

| | | |
|---|---|---|
| JP | 2008-275755 | 11/2008 |
| JP | 2013-137470 | 7/2013 |
| JP | 2013-148837 | 8/2013 |
| JP | 2014-174358 | 9/2014 |
| JP | 2016-109732 | 6/2016 |

* cited by examiner

FIXING DEVICE INCLUDING A LUBRICANT HOLDER AND IMAGE FORMING APPARATUS

CROSS-REFERENCE TO RELATED APPLICATIONS

This patent application is based on and claims priority pursuant to 35 U.S.C. § 119(a) to Japanese Patent Application No. 2017-124188, filed on Jun. 26, 2017, in the Japan Patent Office, the entire disclosure of which is hereby incorporated by reference herein.

BACKGROUND

Technical Field

The present disclosure relates to a fixing device and an image forming apparatus.

Description of the Related Art

A fixing device for use in an image forming apparatus, such as copier and printer, is known that includes a flexible fixing belt supported by a guide (i.e., a belt guide) at each end of the fixing belt in a width direction thereof.

The fixing device further includes a pressure roller, a nip formation pad, a heater, and guides. The nip formation pad presses against the pressure roller via the fixing belt to form a fixing nip between the pressure roller and the fixing belt. The heater is disposed inside a loop formed by the fixing belt. To decrease a frictional resistance of the nip formation pad against the fixing belt sliding over the nip formation pad, a lubricant is directly applied to a portion of the nip formation pad which slidably contacts the fixing belt, or alternatively, a sheet impregnated with a lubricant covers the nip formation pad.

As a driver drives and rotates the pressure roller, the fixing belt rotates in accordance with rotation of the pressure roller by friction therebetween generated at the fixing nip.

As a sheet bearing a toner image is conveyed through the fixing nip, the fixing belt directly heated by the heater and the pressure roller fix the toner image on the sheet under heat and pressure.

SUMMARY

In accordance with some embodiments of the present invention, a fixing device is provided. The fixing device includes a fixing belt rotatable in a predetermined direction, a heater to heat the fixing belt, a pressure rotator in contact with an outer circumferential surface of the fixing belt, a nip formation pad disposed inside a loop formed by the fixing belt and pressed against the pressure rotator via the fixing belt to form a fixing nip through which a sheet is conveyed, and a pair of guides in contact with an inner circumferential surface of the fixing belt at both ends of the fixing belt in a width direction of the fixing belt, to maintain a substantially cylindrical posture of the fixing belt. Each of the guides includes a guide portion in contact with the inner circumferential surface of the fixing belt and a lubricant holder holding a lubricant. The lubricant holder is disposed adjacent to the guide portion and not in contact with the inner circumferential surface of the fixing belt.

In accordance with some embodiments of the present invention, an image forming apparatus is provided. The image forming apparatus includes the above-described fixing device.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
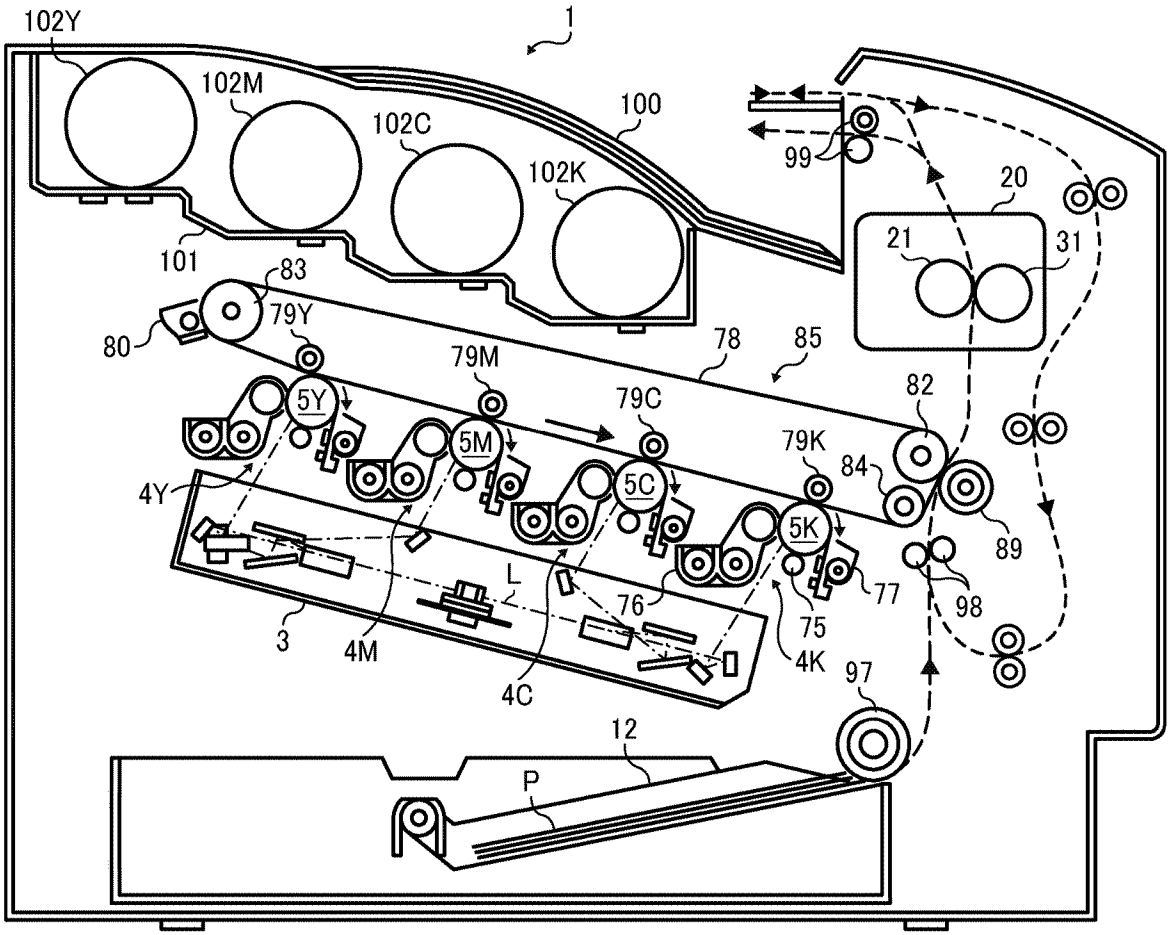
FIG. 1 is a schematic vertical cross-sectional view of an image forming apparatus according to an embodiment of the present invention.

The accompanying drawings are intended to depict example embodiments of the present invention and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that have a similar function, operate in a similar manner, and achieve a similar result.

For the sake of simplicity, the same reference number will be given to identical constituent elements such as parts and materials having the same functions and redundant descriptions thereof omitted unless otherwise stated.

In the conventional fixing device described above, even when a lubricant is applied to a guide portion of the guide which slidably contacts the fixing belt, the lubricant gradually moves away from the guide portion. As a result, the lubricant is not able to sufficiently maintain the effect of reducing abrasion of the fixing belt and the guide.

In accordance with some embodiments of the present invention, a fixing device is provided that stably reduces abrasion of the fixing belt and the guide caused by slidable contact therebetween for an extended period of time.

Referring to FIG. 1, a description is provided of a construction and an operation of an image forming apparatus 1.

As illustrated in FIG. 1, the image forming apparatus 1 is a tandem color printer. In an upper portion of the image forming apparatus 1 is a bottle housing 101 that accommodates four toner bottles 102Y, 102M, 102C, and 102K containing fresh yellow, magenta, cyan, and black toners, respectively, and being detachably attached to the bottle housing 101 for replacement.

Below the bottle housing 101 is an intermediate transfer unit 85. The intermediate transfer unit 85 includes an intermediate transfer belt 78 disposed opposite four image forming devices 4Y, 4M, 4C, and 4K, arranged along the intermediate transfer belt 78, that form yellow, magenta, cyan, and black toner images, respectively.

The image forming devices 4Y, 4M, 4C, and 4K include photoconductive drums 5Y, 5M, 5C, and 5K, respectively. Each of the photoconductive drums 5Y, 5M, 5C, and 5K is surrounded by a charger 75, a developing device 76, a cleaner 77, a discharger, and the like. Image forming processes including a charging process, an exposure process, a developing process, a primary transfer process, and a cleaning process are performed on an outer circumferential surface of each of the photoconductive drums 5Y, 5M, 5C, and 5K, forming yellow, magenta, cyan, and black toner images on the photoconductive drums 5Y, 5M, 5C, and 5K, respectively.

A drive motor drives and rotates the photoconductive drums 5Y, 5M, 5C, and 5K clockwise in FIG. 1. The charger 75 disposed opposite each of the photoconductive drums 5Y, 5M, 5C, and 5K uniformly charges the outer circumferential surface thereof in a charging process.

When the charged outer circumferential surface of each of the photoconductive drums 5Y, 5M, 5C, and 5K reaches an irradiation position where an exposure device 3 is disposed opposite each of the photoconductive drums 5Y, 5M, 5C, and 5K, laser beams L emitted from the exposure device 3 irradiate and scan the photoconductive drums 5Y, 5M, 5C, and 5K, respectively, forming electrostatic latent images according to yellow, magenta, cyan, and black image data in an exposure process.

When the scanned outer circumferential surface of each of the photoconductive drums 5Y, 5M, 5C, and 5K reaches a developing position where the developing device 76 is disposed opposite each of the photoconductive drums 5Y, 5M, 5C, and 5K, the developing device 76 develops the electrostatic latent image formed on the respective photoconductive drums 5Y, 5M, 5C, and 5K, thus forming yellow, magenta, cyan, and black toner images on the photoconductive drums 5Y, 5M, 5C, and 5K in a developing process.

When the yellow, magenta, cyan, and black toner images formed on the photoconductive drums 5Y, 5M, 5C, and 5K reach primary transfer nips formed between the photoconductive drums 5Y, 5M, 5C, and 5K and the intermediate transfer belt 78 by four primary transfer rollers 79Y, 79M, 79C, and 79K pressed against the four photoconductive drums 5Y, 5M, 5C, and 5K via the intermediate transfer belt 78, respectively, the yellow, magenta, cyan, and black toner images formed on the photoconductive drums 5Y, 5M, 5C, and 5K, respectively, are primarily transferred onto the intermediate transfer belt 78 in a primary transfer process. After the primary transfer process, residual toner failed to be transferred onto the surface of the intermediate transfer belt 78 remains on the photoconductive drums 5Y, 5M, 5C, and 5K slightly.

When the residual toner on the outer circumferential surface of each of the photoconductive drums 5Y, 5M, 5C, and 5K reaches a cleaning position where the cleaner 77 is disposed opposite each of the photoconductive drums 5Y, 5M, 5C, and 5K, a cleaning blade of the cleaner 77 mechanically collects the residual toner from each of the photoconductive drums 5Y, 5M, 5C, and 5K in a cleaning process.

Finally, when the cleaned outer circumferential surface of each of the photoconductive drums 5Y, 5M, 5C, and 5K reaches a discharging position where the discharger is disposed opposite each of the photoconductive drums 5Y, 5M, 5C, and 5K, the discharger eliminates residual potential from each of the photoconductive drums 5Y, 5M, 5C, and 5K.

Thus, a series of image forming processes performed on the photoconductive drums 5Y, 5M, 5C, and 5K is finished.

The yellow, magenta, cyan, and black toner images formed on the photoconductive drums 5Y, 5M, 5C, and 5K in the developing process are primarily transferred onto an outer circumferential surface of the intermediate transfer belt 78 such that the yellow, magenta, cyan, and black toner images are superimposed on a same position on the intermediate transfer belt 78. Thus, a full color toner image is formed on the outer circumferential surface of the intermediate transfer belt 78.

For example, the intermediate transfer unit 85 includes the intermediate transfer belt 78, the four primary transfer rollers 79Y, 79M, 79C, and 79K, a secondary transfer backup roller 82, a cleaning backup roller 83, a tension roller 84, and an intermediate transfer belt cleaner 80. The intermediate transfer belt 78 is stretched taut across and supported by the three rollers, that is, the secondary transfer backup roller 82, the cleaning backup roller 83, and the tension roller 84. One of the three rollers, that is, the secondary transfer backup roller 82 drives and rotates the intermediate transfer belt 78 in a direction indicated by arrow in FIG. 1.

The four primary transfer rollers 79Y, 79M, 79C, and 79K sandwich the intermediate transfer belt 78 together with the four photoconductive drums 5Y, 5M, 5C, and 5K, respectively, forming the four primary transfer nips between the intermediate transfer belt 78 and the photoconductive drums 5Y, 5M, 5C, and 5K. The primary transfer rollers 79Y, 79M, 79C, and 79K are applied with a primary transfer bias having a polarity opposite a polarity of electric charge of toner.

As the intermediate transfer belt 78 rotates in the direction indicated by arrow in FIG. 1 and travels through the four primary transfer nips successively, the yellow, magenta, cyan, and black toner images formed on the four photoconductive drums 5Y, 5M, 5C, and 5K, respectively, are primarily transferred onto the intermediate transfer belt 78 such that the yellow, magenta, cyan, and black toner images are superimposed on the same position on the intermediate transfer belt 78.

Thereafter, the yellow, magenta, cyan, and black toner images superimposed on the intermediate transfer belt 78 reach a secondary transfer position where a secondary transfer roller 89 is disposed opposite the intermediate transfer belt 78. At the secondary transfer position, the secondary transfer backup roller 82 sandwiches the intermediate transfer belt 78 together with the secondary transfer roller 89, forming a secondary transfer nip between the secondary transfer roller 89 and the intermediate transfer belt 78. The yellow, magenta, cyan, and black toner images superimposed on the intermediate transfer belt 78 are secondarily transferred onto a sheet P conveyed through the secondary transfer nip in a secondary transfer process. After the secondary transfer process, residual toner failed to be transferred on the sheet P remains on the intermediate transfer belt 78.

Thereafter, the residual toner remaining on the outer circumferential surface of the intermediate transfer belt 78 reaches a cleaning position where the intermediate transfer belt 78 is disposed opposite the intermediate transfer belt cleaner 80. When the residual toner on the intermediate transfer belt 78 reaches the cleaning position, the intermediate transfer belt cleaner 80 collects the residual toner from the intermediate transfer belt 78.

Thus, a series of transfer processes performed on the intermediate transfer belt 78 is finished.

The sheet P conveyed through the secondary transfer nip is conveyed from a paper tray 12 situated in a lower portion of the image forming apparatus 1 through a feed roller 97, a registration roller pair 98 (e.g., a timing roller pair), and the like.

The paper tray 12 loads a plurality of sheets P (e.g., paper sheets) layered. As the feed roller 97 rotates counterclockwise in FIG. 1, the feed roller 97 feeds an uppermost sheet P to a roller nip formed between two rollers of the registration roller pair 98.

As the sheet P contacts the roller nip of the registration roller pair 98, the registration roller pair 98 that interrupts its rotation temporarily halts the sheet P. The registration roller pair 98 resumes its rotation to feed the sheet P to the secondary transfer nip at a time when the color toner image formed on the intermediate transfer belt 78 reaches the secondary transfer nip. As the sheet P is conveyed through the secondary transfer nip, the color toner image formed on the intermediate transfer belt 78 is secondarily transferred onto the sheet P.

Thereafter, the sheet P transferred with the color toner image at the secondary transfer nip is conveyed to a fixing device 20. The fixing device 20 includes a fixing belt 21 serving as a fixing rotator and a pressure roller 31 serving as a pressure rotator pressed against the fixing belt 21 to form a fixing nip therebetween. As the sheet P bearing the color toner image is conveyed through the fixing nip, the fixing belt 21 and the pressure roller 31 fix the color toner image on the sheet P under heat and pressure in a fixing process.

Thereafter, the sheet P bearing the fixed toner image is conveyed through a roller nip formed by an output roller pair 99 and ejected by the output roller pair 99 onto an outside of the image forming apparatus 1. The sheet P ejected by the output roller pair 99 onto the outside of the image forming apparatus 1 is stacked on an output tray 100 as a print.

Thus, a series of image forming processes performed by the image forming apparatus 1 is completed.

Referring to FIGS. 2 to 6, a description is provided of a construction and an operation of the fixing device 20 incorporated in the image forming apparatus 1.

The fixing device 20 conveys the sheet P (bearing an unfixed toner image) while heating the sheet P.

Figure 2:
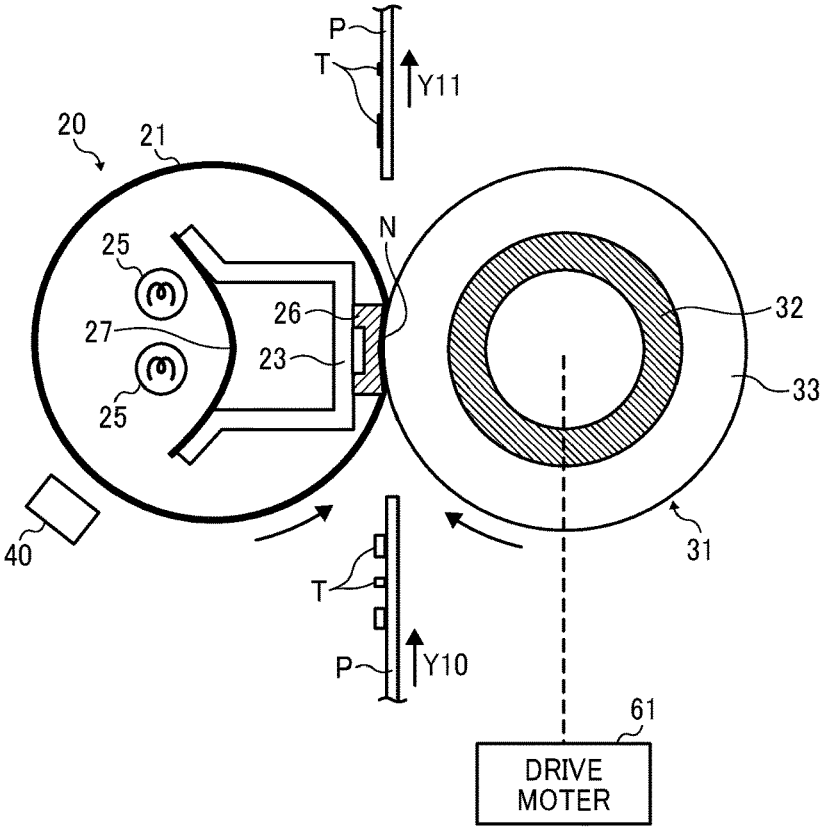
FIG. 2 is a schematic vertical cross-sectional view of a fixing device according to an embodiment of the present invention.
Figure 3:
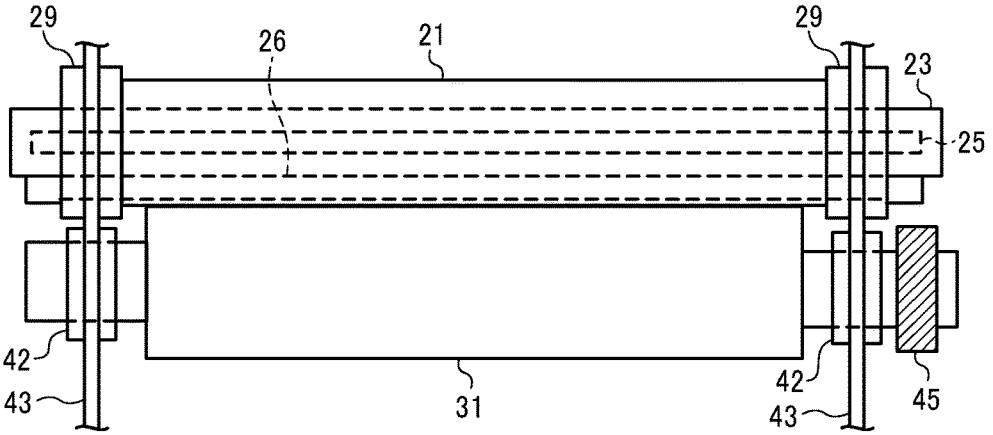
FIG. 3 is a top view of the fixing device in a width (axial) direction.
Figure 4:
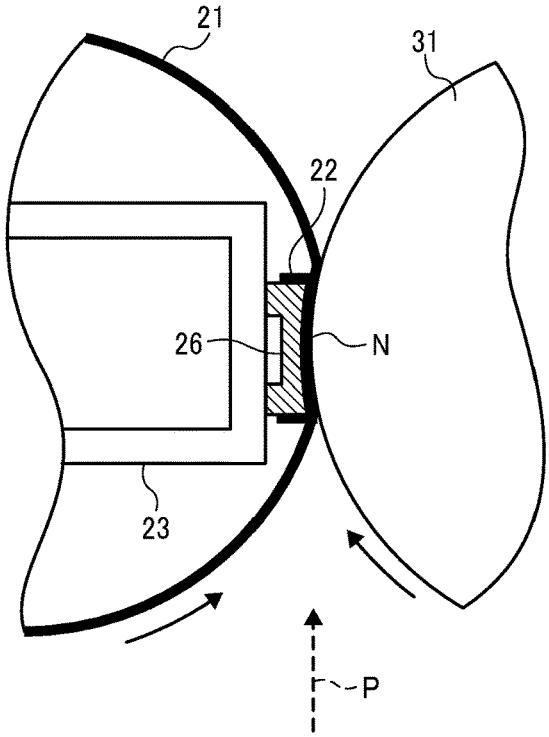
FIG. 4 is a partially enlarged, vertical cross-sectional view of the fixing device, illustrating a vicinity of a fixing nip.

As illustrated in FIGS. 2 to 4, the fixing device 20 includes the fixing belt 21 serving as a fixing rotator, a nip formation pad 26, a reinforcement 23, a heater 25 serving as a heat source, a reflector 27, the pressure roller 31 serving as a pressure rotator, a temperature sensor 40 serving as a temperature detector, a lubricant supplying sheet 22 serving as a lubricant supplier, and a pair of guides 29.

The fixing belt 21 is an endless belt disposed in contact with an outer circumferential surface of the pressure roller 31 driven to rotate by rotation of the pressure roller 31. The fixing belt 21 is a thin, flexible endless belt driven to rotate counterclockwise in FIG. 2. The fixing belt 21 is constructed of a base layer serving as an inner circumferential surface (i.e., a surface slides over the nip formation pad 26), an elastic layer coating the base layer, and a release layer coating the elastic layer, which define a total thickness of the fixing belt 21 not greater than 1 mm.

The base layer, having a layer thickness in a range of from about 30 micrometers to about 50 micrometers, is made of metal such as nickel and stainless steel or resin such as polyimide.

The elastic layer, having a layer thickness in a range of from 100 micrometers to 300 micrometers, is made of rubber such as silicone rubber, silicone rubber foam, and fluoro rubber. The elastic layer absorbs slight surface asperities of the fixing belt 21 at a fixing nip N formed between the fixing belt 21 and the pressure roller 31, facilitating even heat conduction from the fixing belt 21 to a toner image T on a sheet P and thereby suppressing formation of an orange peel image on the sheet P.

The release layer, having a layer thickness in a range of from 5 micrometers to 50 micrometers, is made of tetrafluoroethylene-perfluoroalkyl vinyl ether copolymer (PFA), polytetrafluoroethylene (PTFE), polyimide (PI), polyether imide (PEI), polyether sulfone (PES), or the like. The release layer facilitates separation or peeling-off of toner of the toner image T on the sheet P from the fixing belt 21.

The nip formation pad 26, the heater 25, the reinforcement 23, the lubricant supplying sheet 22, and the reflector 27 are disposed inside the loop formed by the fixing belt 21 and disposed opposite the inner circumferential surface of the fixing belt 21.

The nip formation pad 26 is disposed opposite the inner circumferential surface of the fixing belt 21. The nip formation pad 26 presses against the pressure roller 31 via the fixing belt 21 to form a fixing nip (e.g., the fixing nip N) between the pressure roller 31 and the fixing belt 21, through which the sheet P is conveyed. The nip formation pad 26 is disposed inside the loop formed by the fixing belt 21 such that the inner circumferential surface of the fixing belt 21 slides over the nip formation pad 26. The nip formation pad 26 presses against the pressure roller 31 via the fixing belt 21 to form the fixing nip N between the fixing belt 21 and the pressure roller 31, through which the sheet P is conveyed.

The heater 25 disposed inside the loop formed by the fixing belt 21 heats the fixing belt 21 directly with radiation heat. The heater 25 heats the fixing belt 21 for heating the sheet P. Specifically, the heater 25 heats a circumferential region of the fixing belt 21 other than the fixing nip N.

The heater 25 is a halogen heater (or carbon heater), and both lateral ends thereof are secured to side plates 43 in the fixing device 20, as illustrated in FIG. 3. As a controller controls output of the heater 25, the heater 25 heats the fixing belt 21 with radiation heat mainly in a region on the fixing belt 21 other than the fixing nip N (i.e., a region facing the heater 25). Heat is conducted from an outer circumferential surface of the fixing belt 21 heated by the heater 25 to the toner image T on the sheet P. Output of the heater 25 is controlled based on the temperature of the outer circumferential surface of the fixing belt 21 detected by the temperature sensor 40. The temperature sensor 40 is a thermopile, a thermistor, or the like, disposed opposite the outer circumferential surface of the fixing belt 21. Thus, the fixing belt 21 is heated to a desired fixing temperature by the heater 25 controlled as described above.

According to this embodiment, two heaters 25 are disposed opposite the inner circumferential surface of the fixing belt 21. Alternatively, single heater or three or more heaters may be disposed opposite the inner circumferential surface of the fixing belt 21.

The heater 25 does not heat a part of the fixing belt 21 locally but does heat the fixing belt 21 in a substantial span of the fixing belt 21 in a circumferential direction of the fixing belt 21. Accordingly, even if the fixing belt 21 rotates at high speed, the heater 25 heats the fixing belt 21 sufficiently, suppressing fixing failure. That is, the fixing device 20 heats the fixing belt 21 efficiently with a relatively simple structure, shortening a warm-up time and a first print time taken to output the sheet P bearing the fixed toner image T upon receipt of a print job through preparation for a print operation and the subsequent print operation and downsizing the fixing device 20.

Since the heater 25 heats the fixing belt 21 directly, the heater 25 heats the fixing belt 21 with improved heating efficiency of heating the fixing belt 21, allowing the fixing device 20 to be downsized at reduced manufacturing costs.

Figure 5:
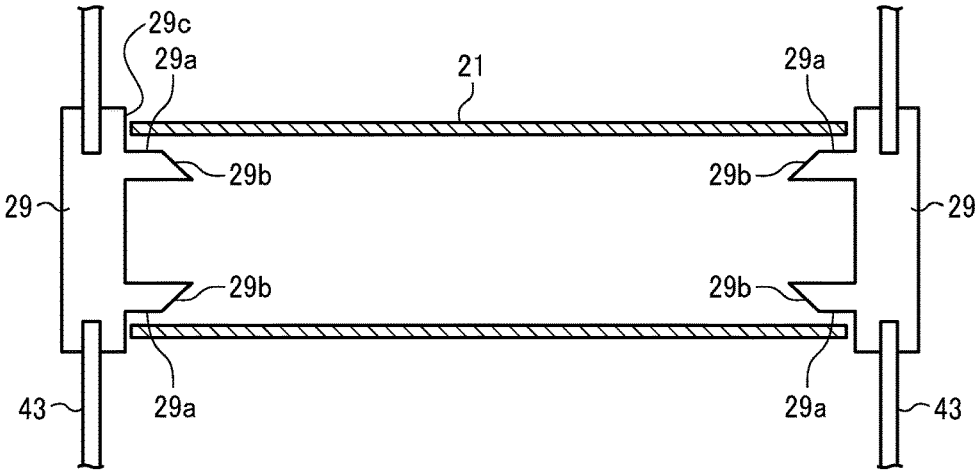
FIG. 5 is a schematic horizontal cross-sectional view of a fixing belt and a guide included in the fixing device in a width (axial) direction.

Referring to FIG. 5, the guides 29 guide respective ends of the fixing belt 21 in a width direction thereof from an inner circumferential surface side of the fixing belt 21 such that the fixing belt 21 can maintain a substantially cylindrical posture.

The guides 29 are made of a resin material comprising glass fiber having heat resistance and high mechanical strength. The guides 29 are fitted in the respective side plates 43 disposed at both ends of the fixing device 20 in the width direction, respectively. Each of the guide 29 includes a guide portion 29*a*, a stopper 29*c*, and a lubricant holder 29*b*. The guide portion 29*a* supports the fixing belt 21 to maintain a substantially cylindrical posture thereof. The stopper 29*c* restricts motion or skew of the fixing belt 21 in the width direction thereof. The lubricant holder 29*b* is configured to hold a lubricant.

The guides 29 support the fixing belt 21 at both end portions of the fixing belt 21 in the width direction within a circumferential region not including the fixing nip N, so as not to inhibit formation of the fixing nip N by the nip formation pad 26.

According to this embodiment, the inner circumferential surface of the fixing belt 21 is loosely contacted only by the guides 29 at respective ends of the fixing belt 21 in the width direction thereof and the nip formation pad 26 via the lubricant supplying sheet 22. No other component, such as a belt guide, contacts the inner circumferential surface of the fixing belt 21 to guide the fixing belt 21 as it rotates.

In order to improve heating efficiency of heating the fixing belt 21 and downsize the fixing device 20 at reduced manufacturing costs, a heat pipe is removed from the fixing device 20 and the heater 25 heats the fixing belt 21 directly without the heat pipe interposed between the heater 25 and the fixing belt 21.

In the present embodiment, each of the guides 29 further includes the lubricant holder 29*b*, in addition to the guide portion 29*a* and the stopper 29*c*, as described above. The lubricant holder 29*b* is described in detail later with reference to FIGS. 5 and 6.

According to the present embodiment, the reinforcement 23 is disposed inside the loop formed by the fixing belt 21. The reinforcement 23 presses against the pressure roller 31 via the nip formation pad 26 and the fixing belt 21. The reinforcement 23 reinforces the nip formation pad 26 that forms the fixing nip N, enhancing the mechanical strength of the nip formation pad 26.

As illustrated in FIG. 3, the reinforcement 23 has a length in a width direction thereof that is greater than a length of the nip formation pad 26 in a width direction thereof. The reinforcement 23 is supported by the side plates 43 of the fixing device 20 at each ends thereof in the width direction thereof.

The reinforcement 23 contacts the pressure roller 31 via the nip formation pad 26 and the fixing belt 21, suppressing substantial deformation of the nip formation pad 26 at the fixing nip N by pressure from the pressure roller 31. The reinforcement 23 is made of a metallic material having an increased mechanical strength, such as stainless steel and iron, to attain the advantages described above.

According to this embodiment, the reflector 27 is fixedly disposed between the reinforcement 23 and the heater 25. Accordingly, the reflector 27 reflects heat radiated from the heater 25 toward the reinforcement 23, that is, infrared ray that may heat the reinforcement 23, to the fixing belt 21 so that the heat is used to heat the fixing belt 21, improving heating efficiency in heating the fixing belt 21. The reflector 27 is made of aluminum, stainless steel, or the like.

Alternatively, the opposed face of the reinforcement 23, which is disposed opposite the heater 25, may be partially or entirely treated with mirror polishing or coated with an insulator. In this case also, the reinforcement 23 attains the advantages described above.

As illustrated in FIG. 2, the pressure roller 31 serving as a pressure rotator contacts an outer circumferential surface of the fixing belt 21. The pressure roller 31 includes a cored bar 32 (serving as an axial portion) and an elastic layer 33 coating the cored bar 32. The pressure roller 31 is driven and rotated clockwise in FIG. 2 by a drive motor 61.

The cored bar 32 is a hollow structure made of a metallic material. The elastic layer 33 is made of silicone rubber foam, silicone rubber, fluoro rubber, or the like. Optionally, a thin release layer made of PFA, PTFE, or the like may coat an outer circumferential surface of the elastic layer 33. The pressure roller 31 is pressed against the fixing belt 21 to form the desired fixing nip N between the pressure roller 31 and the fixing belt 21. As illustrated in FIG. 3, the pressure roller 31 mounts a gear 45 that engages a driving gear of the drive motor 61 so that the pressure roller 31 is driven and rotated clockwise in FIG. 2. Both ends of the pressure roller 31 in a width direction thereof are rotatably supported by the side plates 43 of the fixing device 20 through bearings 42, respectively.

If the elastic layer 33 of the pressure roller 31 is made of sponge such as silicone rubber foam, the elastic layer 33 decreases pressure exerted to the fixing nip N, reducing a load imposed on the nip formation pad 26. Additionally, the elastic layer 33 made of sponge enhances thermal insulation of the pressure roller 31, reducing heat conduction from the fixing belt 21 to the pressure roller 31 and thereby improving heating efficiency in heating the fixing belt 21.

Referring to FIG. 4, the nip formation pad 26 that slides over the inner circumferential surface of the fixing belt 21 includes an opposed face (e.g., a slide face) that is disposed opposite the pressure roller 31 and curved in cross-section to produce a recess along a curve of the pressure roller 31. Accordingly, the sheet P is curved along the curve of the pressure roller 31 as the sheet P is ejected from the fixing nip N, suppressing a failure in which the sheet P ejected from the fixing nip N adheres to the fixing belt 21 and thereby does not separate from the fixing belt 21.

According to this embodiment, the nip formation pad 26 is recessed relative to the pressure roller 31 at the fixing nip N. Alternatively, the nip formation pad 26 may be planar in cross-section at the fixing nip N. For example, the opposed face (e.g., the slide face) of the nip formation pad 26, which is disposed opposite the pressure roller 31, may be planar in cross-section. In this case, the opposed face of the nip formation pad 26 at the fixing nip N is substantially parallel to an imaged face of the sheet P, which bears the toner image T, facilitating adhesion of the fixing belt 21 to the sheet P and enhancing fixing property of heating the fixing belt 21 quickly. Additionally, a curvature of the fixing belt 21 at an exit of the fixing nip N is greater than that of the pressure roller 31, facilitating separation of the sheet P ejected from the fixing nip N from the fixing belt 21.

The nip formation pad 26 may be made of a resin material or a metallic material. Preferably, the nip formation pad 26 is made of a resin material that has a rigidity great enough to prevent substantial bending even if the nip formation pad 26 receives pressure from the pressure roller 31 and is febrile and heat-insulative, such as liquid crystal polymer (LCP), polyamide imide (PAI), polyether sulfone (PES), polyphenylene sulfide (PPS), polyether nitrile (PEN), and polyether ether ketone (PEEK). According to this embodiment, the nip formation pad 26 is made of LCP.

Referring to FIG. 4, the lubricant supplying sheet 22 covers the nip formation pad 26. The lubricant supplying sheet 22 is made of a low-friction material, such as PTFE, that decreases a resistance of the nip formation pad 26 against the fixing belt 21 sliding over the nip formation pad 26. For example, the lubricant supplying sheet 22 is sandwiched between the nip formation pad 26 and the fixing belt 21 at the fixing nip N throughout the substantially entire width of the fixing belt 21 in the axial direction thereof. Accordingly, the lubricant supplying sheet 22 substantially surrounds or circumferentially covers part or entire of the nip formation pad 26 in cross-section in FIG. 4. According to this embodiment, the lubricant supplying sheet 22 is made of a fiber, such as cloth made of fluoroplastic such as PTFE, impregnated with a lubricant. Accordingly, the lubricant supplying sheet 22 covering a belt side face of the nip formation pad 26 bears the lubricant. Consequently, the lubricant supplying sheet 22 reduces abrasion of the fixing belt 21 and the nip formation pad 26 that may be caused by slidable contact between the fixing belt 21 and the nip formation pad 26.

The lubricant impregnated in the lubricant supplying sheet 22 may be, for example, fluorine grease, silicone grease, silicone oil, or the like.

According to this embodiment, the lubricant supplying sheet 22 impregnated with a lubricant is interposed between the nip formation pad 26 and the fixing belt 21. Thus, the nip formation pad 26 indirectly slides over the fixing belt 21 with the lubricant therebetween. Alternatively, a lubricant may be directly applied to the nip formation pad 26 and the fixing belt 21, to directly interpose the lubricant between the nip formation pad 26 and the fixing belt 21 without disposing the lubricant supplying sheet 22 impregnated with the lubricant, so that the nip formation pad 26 directly slides over the fixing belt 21 with the lubricant therebetween.

A description is provided of a regular fixing operation to fix the toner image T on the sheet P, which is performed by the fixing device 20 having the construction described above.

As the image forming apparatus 1 is powered on, the heater 25 is supplied with power and the driver starts driving and rotating the pressure roller 31 clockwise in FIG. 2. Accordingly, the pressure roller 31 drives and rotates the fixing belt 21 counterclockwise in FIG. 2 by friction therebetween generated at the fixing nip N.

As illustrated in FIG. 1, the feed roller 97 picks up and feeds a sheet P from the paper tray 12 to the registration roller pair 98 that conveys the sheet P to the secondary transfer nip where the secondary transfer roller 89 secondarily transfers an unfixed color toner image, that is, a toner image T, from the intermediate transfer belt 78 onto the sheet P. As illustrated in FIG. 2, the sheet P bearing the unfixed toner image T is conveyed in a direction Y10 while the sheet P is guided by a guide plate and enters the fixing nip N formed between the fixing belt 21 and the pressure roller 31 pressed against the fixing belt 21.

The toner image T is fixed on a surface of the sheet P under heat from the fixing belt 21 heated by the heater 25 and pressure exerted from the nip formation pad 26 and the pressure roller 31 pressed against the nip formation pad 26 supported by the reinforcement 23. Thereafter, the sheet P is ejected from the fixing nip N and conveyed in a direction Y11.

A description is provided of a configuration and an operation of the fixing device 20 in detail.

As described above with reference to FIG. 5, the guides 29 that guide the fixing belt 21 to maintain a substantially cylindrical posture are disposed at respective ends of the fixing device 20 in a width direction thereof.

Figure 6A:
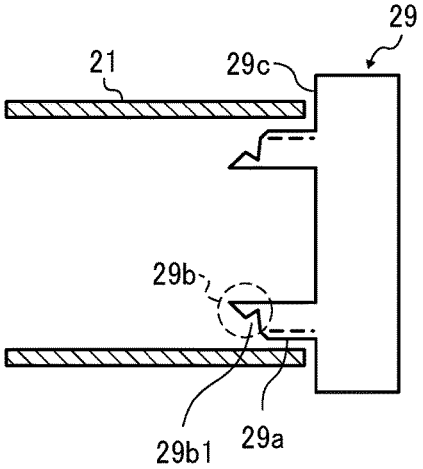
FIG. 6A is a partially enlarged, horizontal cross-sectional view of the fixing belt and the guide
Figure 6B:
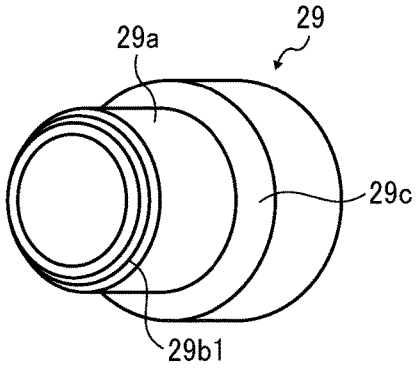
FIG. 6B is a schematic perspective view of the guide.

Referring to FIGS. 5, 6A, and 6B, the guides 29 contact an inner circumferential surface of the fixing belt 21 at respective ends of the fixing belt 21 in the width direction such that the fixing belt 21 can maintain a substantially cylindrical posture.

For easy understanding, FIGS. 5 and 6A are illustrated as if the fixing belt 21 and the guide portion 29*a* are separated from each other. Actually, however, the fixing belt 21 and the guide portion 29*a* are in a loose contact with each other.

According to the present embodiment, each of the guide 29 includes the guide portion 29*a*, the stopper 29*c*, and the lubricant holder 29*b*. The guide portion 29*a* slidably contacts an inner circumferential surface of the fixing belt 21. The stopper 29*c* restricts motion or skew of the fixing belt 21 in the width direction thereof. The lubricant holder 29*b* is configured to hold (or retain) a lubricant.

Neither the guide portion 29*a* nor the stopper 29*c* has a recess, such as a groove, on a surface thereof that reduces frictional resistance against the fixing belt 21 generated when the guide portion 29*a* or the stopper 29*c* slidably contacts the fixing belt 21. According to this embodiment, a lubricant is interposed between the guide portion 29*a* and the fixing belt 21 (i.e., the lubricant is applied to the guide portion 29*a* and the fixing belt 21) so as to reduce abrasion of the guide portion 29*a* and the fixing belt 21 cause by slidable contact therebetween. The lubricant interposed between the guide portion 29*a* and the fixing belt 21 is the same type (material) as the lubricant interposed between the nip formation pad 26 and the fixing belt 21.

As illustrated in FIGS. 5 and 6A, the lubricant holder 29*b* is disposed adjacent to the guide portion 29*a* and not in contact with an inner circumferential surface of the fixing belt 21.

More specifically, as illustrated in FIGS. 6A and 6B, the lubricant holder 29*b* is a tapered portion tapered from the boundary with the guide portion 29*a* toward the center portion of the fixing belt 21 in the width direction (i.e., a left side in FIG. 6A), so as to gradually separate from an inner circumferential surface of the fixing belt 21. The lubricant holder 29*b* includes a groove 29*b*1 retaining a lubricant. The groove 29*b*1, having almost uniform depth and width, is circumferentially formed on the tapered portion.

As the guide 29 includes the lubricant holder 29*b* holding the lubricant, the lubricant is actively supplied to between the guide portion 29*a* and the fixing belt 21. In addition, the lubricant holder 29*b* is capable of holding the lubricant moved from between the guide portion 29*a* and the fixing belt 21 to the center portion of the fixing belt 21 in the width direction.

Since the lubricant holder 29*b* does not slidably contact an inner circumferential surface of the fixing belt 21, the groove 29*b*1 does not damage or abrade the inner circumferential surface of the fixing belt 21. As the amount of the lubricant retained in the groove 29*b*1 of the lubricant holder 29*b* increases, the surplus lubricant is pushed out and supplied to between the guide portion 29*a* and the fixing belt 21.

Accordingly, the lubricant interposed between the guide portion 29*a* and the fixing belt 21 is not depleted with time, and abrasion of the fixing belt 21 and the guides 29 caused by slidable contact therebetween is stably reduced with time.

Variation 1

Figure 7:
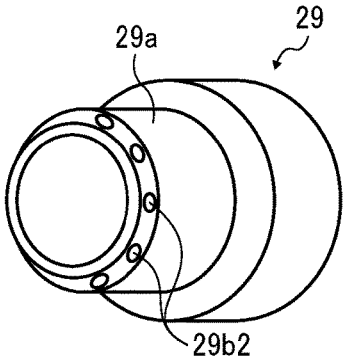
FIG. 7 is a schematic perspective view of the guide according to Variation 1.

FIG. 7 is a schematic perspective view of the guide 29 according to Variation 1. FIG. 7 corresponds to FIG. 6B of the above-described embodiment.

As illustrated in FIG. 7, the guide 29 according to Variation 1 includes multiple grooves 29*b*2 circumferentially formed on the tapered portion in a divided manner. Each of the multiple grooves 29*b*2 retains a lubricant. The amount of lubricant held by the lubricant holder 29*b* can be finely adjusted by adjusting the number of the grooves 29*b*2. Accordingly, the lubricant holder 29*b* is able to hold the right amount of lubricant without excess or shortage. In Variation 1, the tapered portion of the lubricant holder 29*b* includes multiple grooves 29*b*2. Alternatively, the number of the grooves 29*b*2 may be only one.

Variation 2

Figure 8:
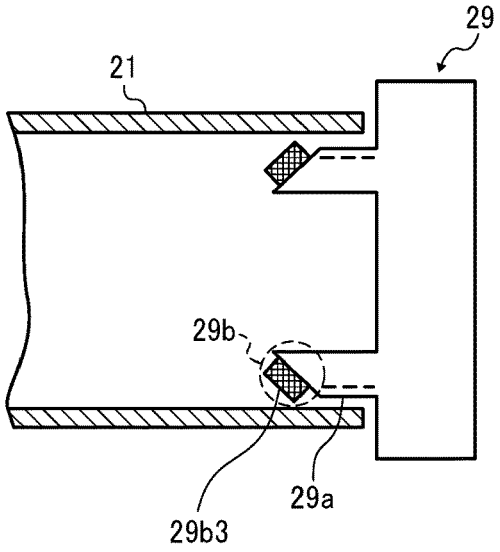
FIG. 8 is a partially enlarged, horizontal cross-sectional view of the fixing belt and the guide according to Variation 2.

FIG. 8 is a schematic magnified view of the guide 29 and the fixing belt 21 according to Variation 2. FIG. 8 corresponds to FIG. 6A of the above-described embodiment.

As illustrated in FIG. 8, the lubricant holder 29*b* according to Variation 2 is a tapered portion tapered from the boundary with the guide portion 29*a* toward the center portion of the fixing belt 21 in the axial direction, so as to gradually separate from an inner circumferential surface of the fixing belt 21, and to which a fibrous member 29*b*3 (such as a piece of cloth) impregnated with a lubricant is adhered.

As the fibrous member 29*b*3 impregnated with a lubricant is attached to the lubricant holder 29*b*, the lubricant is actively supplied to between the guide portion 29*a* and the fixing belt 21. In addition, the fibrous member 29*b*3 is capable of holding the lubricant moved from between the guide portion 29*a* and the fixing belt 21 to the center portion of the fixing belt 21 in the width direction. In particular, the fibrous member 29*b*3 is capable of holding a relatively large amount of lubricant.

Accordingly, the lubricant interposed between the guide portion 29*a* and the fixing belt 21 is not depleted with time, and abrasion of the fixing belt 21 and the guides 29 caused by slidable contact therebetween is stably reduced with time.

Variation 3

Figure 9:
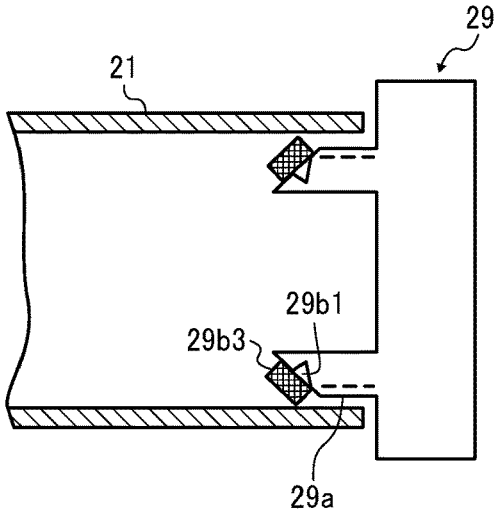
FIG. 9 is a partially enlarged, horizontal cross-sectional view of the fixing belt and the guide according to Variation 3.

FIG. 9 is a schematic magnified view of the guide 29 and the fixing belt 21 according to Variation 3. FIG. 9 corresponds to FIG. 6A of the above-described embodiment.

As illustrated in FIG. 9, the lubricant holder 29*b* according to Variation 3 includes, on the tapered portion thereof, both the groove 29*b*1 and the fibrous member 29*b*3 impregnated with a lubricant.

Accordingly, the lubricant holder 29*b* is capable of holding a much larger amount of lubricant.

As described above, the fixing device 20 according to an embodiment of the present invention includes the fixing belt 21, the pressure roller 31 (serving as a pressure rotator), the nip formation pad 26, and the guides 29 that contact an inner circumferential surface of the fixing belt 21 at respective ends of the fixing belt 21 in a width direction thereof such that the fixing belt 21 can maintain a substantially cylindrical posture. Each of the guides 29 includes the guide portion 29*a* and the lubricant holder 29*b* adjacent to the guide portion 29*a*. The guide portion 29*a* slidably contacts an inner circumferential surface of the fixing belt 21. The lubricant holder 29*b* is configured to hold (or retain) a lubricant without contacting an inner circumferential surface of the fixing belt 21.

Accordingly, abrasion of the fixing belt 21 and the guides 29 caused by slidable contact therebetween is stably reduced with time.

According to the present embodiment, the heater 25 serves as heater or a heat source that heats the fixing belt 21. Alternatively, an exciting coil employing an electromagnetic induction heating method or a resistive heat generator may be used as a heater for heating the fixing belt 21, for example.

In those cases also, the fixing devices attain advantages equivalent to the advantages described above.

In the present disclosure, the width direction defines a direction being perpendicular to a direction of conveying the sheet P and parallel to the axial direction of the fixing belt 21 and the pressure roller 31.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. A fixing device comprising:

a fixing belt rotatable in a predetermined direction;

a heater to heat the fixing belt;

a pressure rotator in contact with an outer circumferential surface of the fixing belt;

a nip formation pad disposed inside a loop formed by the fixing belt and pressed against the pressure rotator via the fixing belt to form a fixing nip through which a sheet is conveyed; and a pair of guides in contact with an inner circumferential surface of the fixing belt at both ends of the fixing belt in a width direction of the fixing belt, to maintain a substantially cylindrical posture of the fixing belt, each of the guides including:

a guide portion in contact with the inner circumferential surface of the fixing belt; and a lubricant holder holding a lubricant, disposed adjacent to the guide portion and not in contact with the inner circumferential surface of the fixing belt.

2. The fixing device of claim 1, wherein the lubricant holder is a tapered portion tapered from a boundary with the guide portion toward a center portion of the fixing belt in the width direction while gradually separating from the inner circumferential surface of the fixing belt, the tapered portion including a groove retaining the lubricant.

3. The fixing device of claim 2, wherein the groove is circumferentially disposed on the tapered portion.

4. The fixing device of claim 2, wherein the groove includes multiple grooves circumferentially disposed on the tapered portion.

5. The fixing device of claim 1, wherein the lubricant holder is a tapered portion tapered from a boundary with the guide portion toward a center portion in the width direction of the fixing belt while gradually separating from the inner circumferential surface of the fixing belt, to which a fibrous member impregnated with the lubricant is adhered.

6. The fixing device of claim 1, wherein the lubricant is interposed between the fixing belt and each of the guide portions, wherein another lubricant is interposed between the fixing belt and the nip formation pad at a position at which the fixing belt directly or indirectly slides over the nip formation pad.

7. An image forming apparatus comprising the fixing device of claim 1.

* * * * *